US009855475B2

(12) United States Patent
Motokawa

(10) Patent No.: US 9,855,475 B2
(45) Date of Patent: Jan. 2, 2018

(54) GOLF CLUB HEAD

(71) Applicant: DUNLOP SPORTS CO. LTD., Kobe-shi, Hyogo (JP)

(72) Inventor: Yuki Motokawa, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 0 days.

(21) Appl. No.: 15/387,257

(22) Filed: Dec. 21, 2016

(65) Prior Publication Data

US 2017/0173414 A1 Jun. 22, 2017

(30) Foreign Application Priority Data

Dec. 22, 2015 (JP) ..... 2015-250574

(51) Int. Cl.
*A63B 53/04* (2015.01)

(52) U.S. Cl.
CPC .. *A63B 53/0466* (2013.01); *A63B 2053/0454* (2013.01)

(58) Field of Classification Search
CPC ..... A63B 53/0466; A63B 2053/0454; A63B 2053/045
USPC ..... 473/324–350, 287–292; 219/76.1; 164/98
See application file for complete search history.

(56) References Cited

U.S. PATENT DOCUMENTS 5,718,641 A * 2/1998 Lin ..... A63B 53/04 473/224
5,908,356 A * 6/1999 Nagamoto ..... A63B 53/04 473/224
5,941,782 A * 8/1999 Cook ..... A63B 53/04 473/346
6,743,119 B2 * 6/2004 Lo ..... A63B 53/0466 473/346
7,247,103 B2 * 7/2007 Beach ..... A63B 53/0466 473/324
7,758,453 B2 * 7/2010 Horacek ..... A63B 53/0466 473/345
7,828,676 B2 * 11/2010 Wada ..... A63B 53/0466 473/346
7,998,000 B2 * 8/2011 Brekke ..... A63B 53/0466 473/345
9,174,103 B2 * 11/2015 Curtis ..... A63B 53/08
9,498,684 B2 * 11/2016 Motokawa ..... A63B 53/0466

FOREIGN PATENT DOCUMENTS

JP 10-24128 A 1/1998
JP 2002-186691 A 7/2002
JP 2009-233266 A 10/2009

* cited by examiner

*Primary Examiner* — Sebastiano Passaniti
(74) *Attorney, Agent, or Firm* — Birch, Stewart, Kolasch & Birch, LLP

(57) ABSTRACT

Provided is a golf club head including a head body that has a hollow structure, a rib, and a welding bead. The head body has a first region. The rib stands upright from an inner surface of the first region. The welding bead fixes the first region and the rib to each other. An opening is formed in side faces of the rib. The welding bead extends from a first position on the inner surface of the first region, passes through the opening, and reaches a second position on the inner surface of the first region.

19 Claims, 10 Drawing Sheets

E1 Cross-section

GOLF CLUB HEAD

CROSS REFERENCE TO RELATED APPLICATIONS

This application claims a priority to Japanese Patent Application No. 2015-250574 filed on Dec. 22, 2015, which is hereby incorporated by reference in its entirety.

FIELD OF INVENTION

The present invention relates to a golf club head.

BACKGROUND

There are many golf club heads in which the head body forms a hollow structure. In recent years, the wall thickness of the head body of this type of golf club head has been progressively reduced for the purpose of reducing the weight of the golf club head. However, this reduction in wall thickness reduces the rigidity of the golf club head, and a reduction in rigidity tends to lead to the problem of a low and dull ball hitting sound that is generally unfavorable.

In view of this, there are cases where a rib is formed on an inner surface of the head body in order to solve the above problem (see Patent Literatures JP H10-24128A, JP 2002-186691A and JP 2009-233266A). This rib effectively improves the rigidity of the golf club head, which had been reduced by the reduction in the wall thickness of the head body, thus making it possible to increase the natural frequency of the golf club head. As a result, a reduction in wall thickness is achieved, and a high and pleasant-sounding ball hitting sound is also obtained.

SUMMARY

However, if a rib is formed in order to improve the ball hitting sound, the weight increases due to the rib, and there are cases where this results in not being able to sufficiently reduce the weight of the golf club head. JP H10-24128A discloses that a rib and a head body are fixed to each other by welding. However, when fixing the rib and the head body by welding, a problem occurs in which a material for the rib is confined, due to the difficulty in welding of parts which are made from different raw materials.

An object of the present invention is to provide a golf club head that has a reduced weight while also preventing degradation in the ball hitting sound. Another object of the preset invention is to provide a fixing structure of a rib and a head body which is applicable to a rib made from any material. Note that the reduction in the weight of the golf club head referred to here includes not only an absolute reduction in the weight of the golf club head, but also ensuring a larger amount of weight (hereinafter referred to as "free weight") that can be freely used to attain various design goals. The free weight referred to here means weight other than the minimum weight required to form the head. The larger the free weight, the higher the degree of freedom for design of the golf club head. The free weight can be used to adjust the position of the center of gravity of the golf club head, the moment of inertia of the golf club head, or the like. Accordingly, if the free weight is allocated to various places in the golf club head, the overall weight of the golf club head does not change, and even in this case, as long as the weight of the golf club head is reduced in a portion other than the portions to which the free weight is allocated, the weight of the golf club can be considered to have been reduced.

Similarly, the phrase "increase in weight" or a similar phrase can mean being able to ensure only a less amount of free weight.

A golf club head according to a first aspect of the present invention that includes a head body that has a hollow structure, a rib, and a welding bead. The head body has a first region. The rib stands upright from an inner surface of the first region. The welding bead fixes the first region and the rib to each other. An opening is formed in side faces of the rib. The welding bead extends from a first position on the inner surface of the first region, passes through the opening, and reaches a second position on the inner surface of the first region.

A golf club head according to a second aspect of the present invention is the golf club head according to the first aspect, wherein the rib is made of a raw material that is different from that of the first region.

A golf club head according to a third aspect of the present invention is the golf club head according to the second aspect, wherein the rib is made of a material that has a lower specific gravity than that of the first region.

A golf club head according to a fourth aspect of the present invention is the golf club head according to any of the first to third aspects, wherein the opening includes a plurality of holes.

A golf club head according to a fifth aspect of the present invention is the golf club head according to the fourth aspect, wherein the welding bead includes a plurality of bead lines that pass through different holes.

A golf club head according to a sixth aspect of the present invention is the golf club head according to the fourth or fifth aspect, wherein the plurality of holes are each a triangle and are aligned such that the rib at least partially forms a truss structure.

A golf club head according to the seventh aspect of the present invention is the golf club head according to any of the first to sixth aspects, wherein the first region is a sole portion.

According to the present invention, a rib is formed on the inner surface of the head body that has a hollow structure, and an opening is formed in side faces of the rib. As a result, the rib improves the rigidity of the golf club head, and the opening formed in the side faces of the rib suppresses an increase in the weight of the golf club head. Accordingly, degradation of the sound when a ball is hit is prevented, and the weight of the golf club is reduced.

Also, according to the present invention, a welding bead that starts from a first position on the inner surface of a first region of the head body, passes through an opening in the rib, and reaches a second position on the inner surface of the first region of the head body fixes the rib and the head body to each other. Accordingly, regardless of whether the rib is made of a raw material the same as or different from that of the head body (more specifically, at least the first region on which the rib is formed), the rib can be anchored to the head body.

DETAILED DESCRIPTION OF THE PREFERRED EMBODIMENTS

Hereinafter, a golf club head according to an embodiment of the present invention will be described with reference to the drawings.

1. Overall Configuration of Golf Club Head

Figure 1:
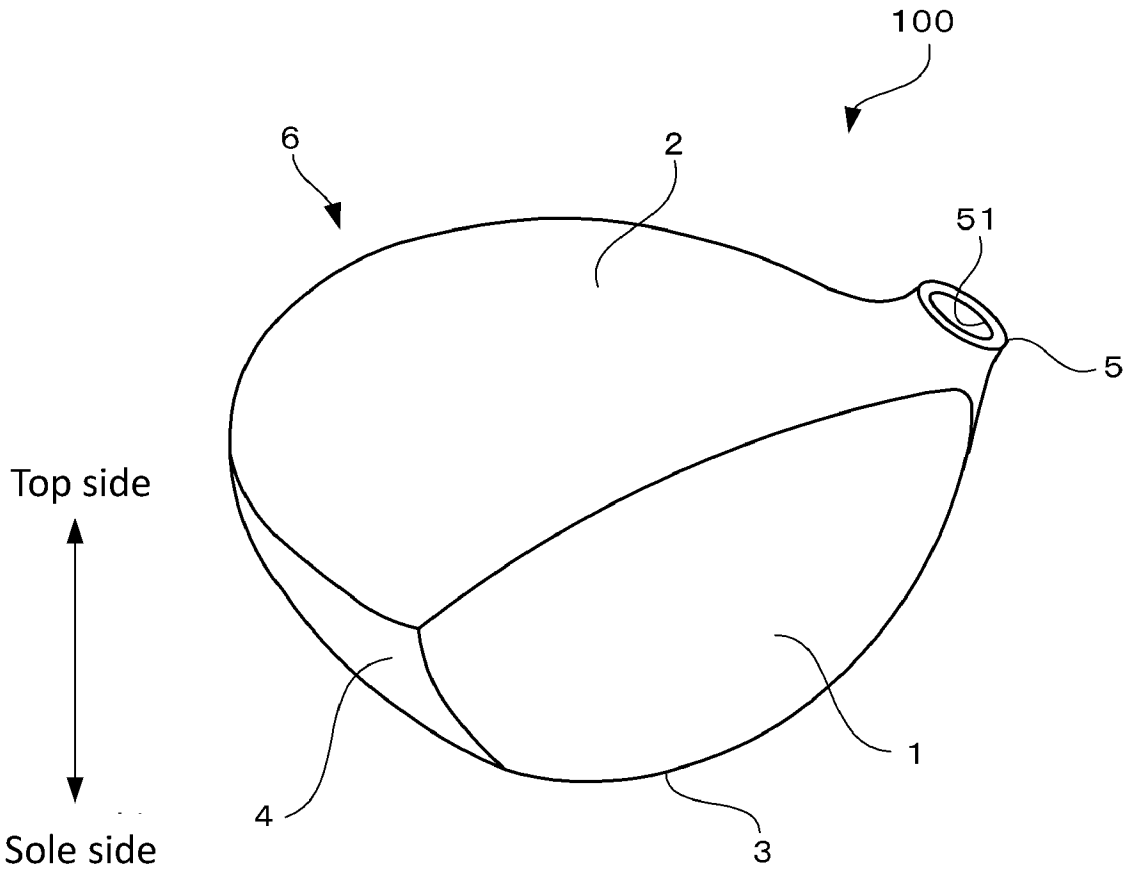
FIG. 1 is a perspective view of a golf club head in a reference state.
Figure 2:
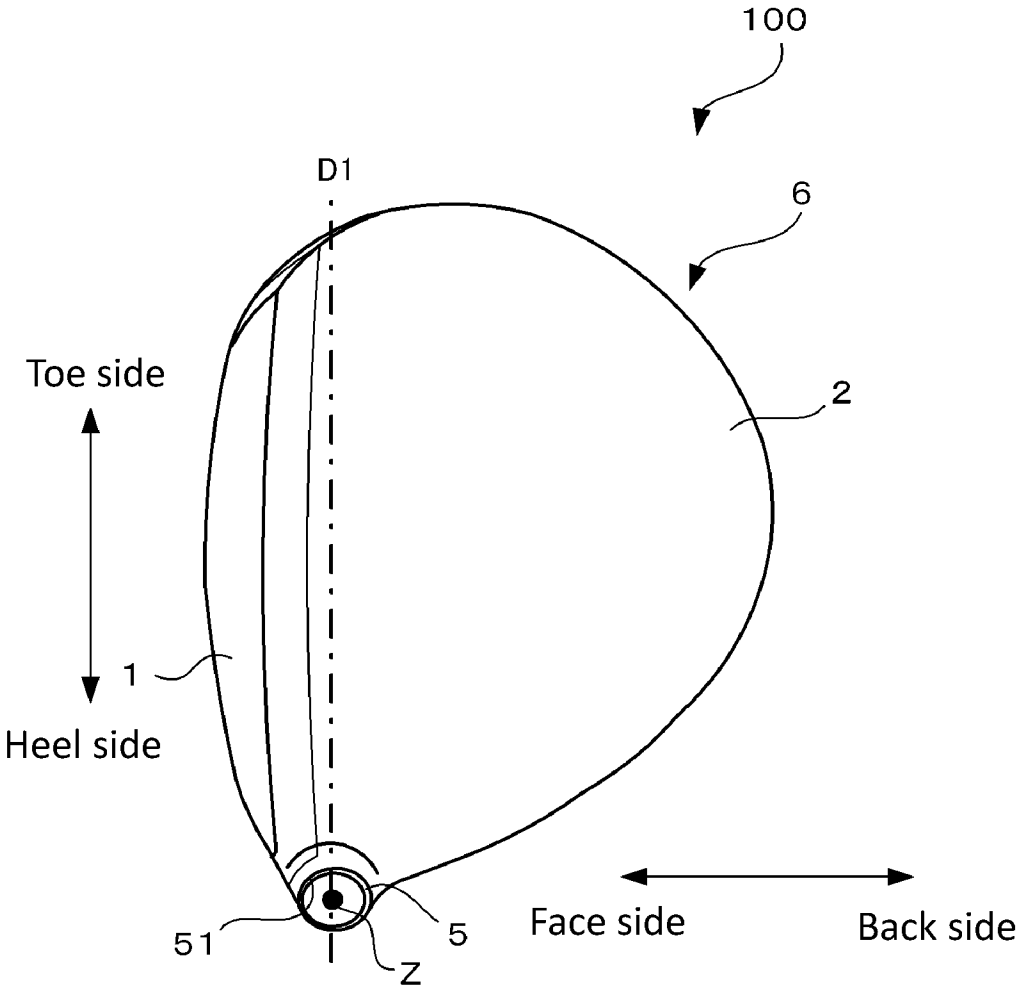
FIG. 2 is a plan view of the golf club head in the reference state.

FIG. 1 is a perspective view of a golf club head (sometimes simply "head" hereinafter) 100 according to the present embodiment in a reference state, and FIG. 2 is a plan view of the head 100 in the reference state. Note that the reference state of the golf club head 100 will be described later. The head 100 has a head body 6 that has a hollow structure, and the head body 6 is formed by a face portion 1, a crown portion 2, a sole portion 3, a side portion 4, and a hosel portion 5, which are walls that are continuous with each other. The head 100 according to the present embodiment is of a wood-type such as a driver (#1) and a fairway wood. However, the type of golf club head to which a later-described rib 7 structure can be applied is not limited to that of the present invention, and as long as the head body has a hollow structure, the head may be a so-called utility type, hybrid type, or the like, or the head may be an iron-type.

The face portion 1 has a face surface for hitting a ball, and constitutes the front portion of the head 100. The face surface is approximately flat. The crown portion 2 is adjacent to the face portion 1 and constitutes the upper surface of the head 100. The sole portion 3 constitutes the bottom surface of the head 100 and is adjacent to the face portion 1 and the side portion 4. Also, the side portion 4 is the region between the crown portion 2 and the sole portion 3, and extends from the toe side of the face portion 1 to the heel side of the face portion 1 across the back side of the head 100. Furthermore, the hosel portion 5 is the region provided adjacent to the heel side of the crown portion 2, and has an insertion hole 51 into which a golf club shaft (not shown) is to be inserted.

The reference state mentioned above will be described below. As shown in FIGS. 1 and 2, the reference state is defined as a state in which a central axis Z of the above-described insertion hole 51 is in a plane D1 (hereinafter, reference perpendicular plane D1) that is perpendicular to a horizontal plane H, and the head 100 is placed on the horizontal plane H so as to attain a predetermined lie angle and hook angle. Also, as shown in FIG. 2, the direction of the line of intersection of the reference perpendicular plane D1 and the horizontal plane H will be referred to as the toe-heel direction, and the direction that is perpendicular to the toe-heel direction and parallel to the horizontal plane H will be referred to as the face-back direction. Also, the direction that is perpendicular to the horizontal plane H is referred to as the top-sole direction.

Figure 3B:
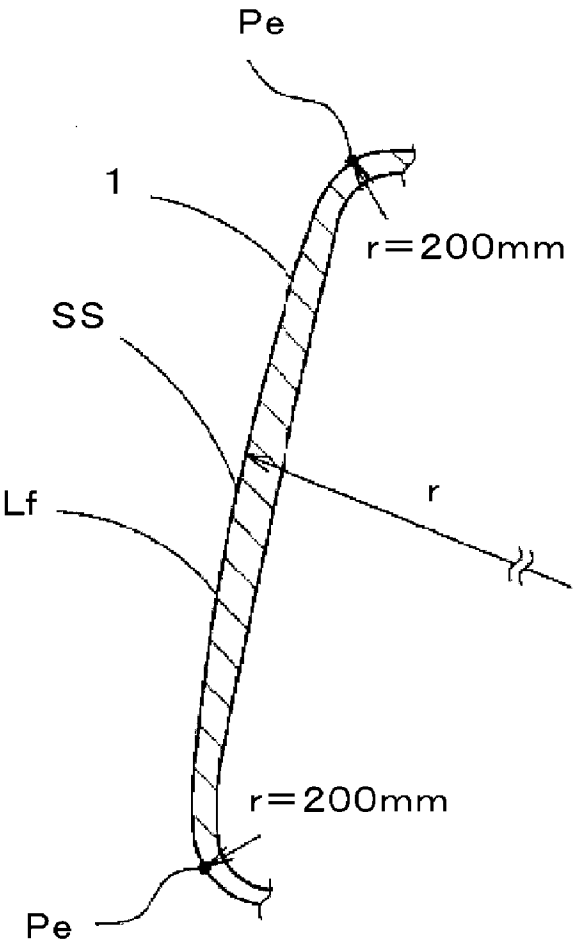
FIGS. 3A and 3B are diagrams illustrating a boundary of a face portion.
Figure 3A:
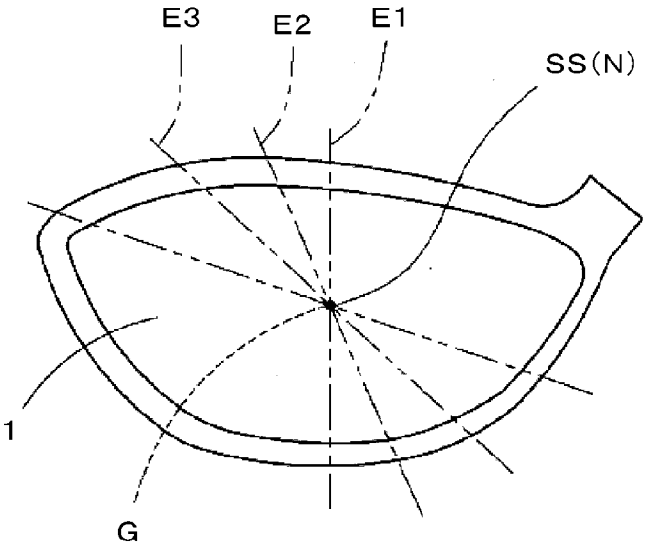

In the present embodiment, the boundary between the crown portion 2 and the side portion 4 can be defined as follows. Specifically, in the case where a ridge line is formed between the crown portion 2 and the side portion 4, that ridge line serves as the boundary. Conversely, in the case where no clear ridge line has been formed, the boundary is the contour that is seen when the head 100 placed in the reference state and viewed from directly above a center of gravity G of the head 100. Similarly, in the case of the boundary between the face portion 1, the crown portion 2, and the sole portion 3, if a ridge line is formed, that ridge line serves as the boundary. On the other hand, in the case where no clear ridge line has been formed, the peripheral edge (boundary) of the face portion 1 is defined by positions Pe where, in cross sections E1, E2, E3 and so on that include a straight line N connecting the center of gravity G of the head 100 and a sweet spot SS as shown in FIG. 3A, a radius of a curvature r of an outline Lf of the outer surface of the face first reaches 200 mm when moving outward from the sweet spot side as shown in FIG. 3B. Note that the sweet spot SS is the intersection of the face surface (that is the outer surface of the face portion 1) and a line that passes through the center of gravity G of the golf club head 100 and is perpendicular to the face surface.

The head body 6 according to the present embodiment is made of a titanium alloy with a specific gravity of approximately 4.0 to 5.0. Also, the volume of the golf club head 100 is preferably 70 $cm^3$ or more, for example. In the case where the golf club head 100 is a driver, the volume is preferably 300 $cm^3$ or more, more preferably 400 $cm^3$ or more, and particularly preferably 420 $cm^3$ or more. A head that has such a volume increases the sense of comfort when taking stance, and is useful for increasing the sweet area and the moment of inertia. Note that the upper limit of the volume of the head is not particularly limited, but in terms of practicality, a volume of 500 $cm^3$ or less for example is desirable, and a volume of 470 $cm^3$ or less is desirable when conforming to R&A and USGA rules and regulations.

The head 100 according to the present embodiment is configured by assembling the main body portion that has the crown portion 2, the sole portion 3, the side portion 4, and the hosel portion 5, to the face portion 1. The main body portion and the face portion 1 are connected to each other through welding (plasma welding, laser welding, brazing, or the like), for example. The main body portion has an opening that is surrounded by the crown portion 2, the sole portion 3, and the side portion 4, and the face portion 1 is attached so as to cover this opening. The main body portion can be assembled from a plurality of parts, and can be formed integrally. Such a main body portion and face portion 1 can be produced using various methods. For example, the main body portion can be manufactured using casting techniques such as the well-known lost wax precision casting technique. Also, the face portion 1 can be manufactured using forging methods, flat plate pressing, and the like, for example.

2. Rib Structure

Figure 4:
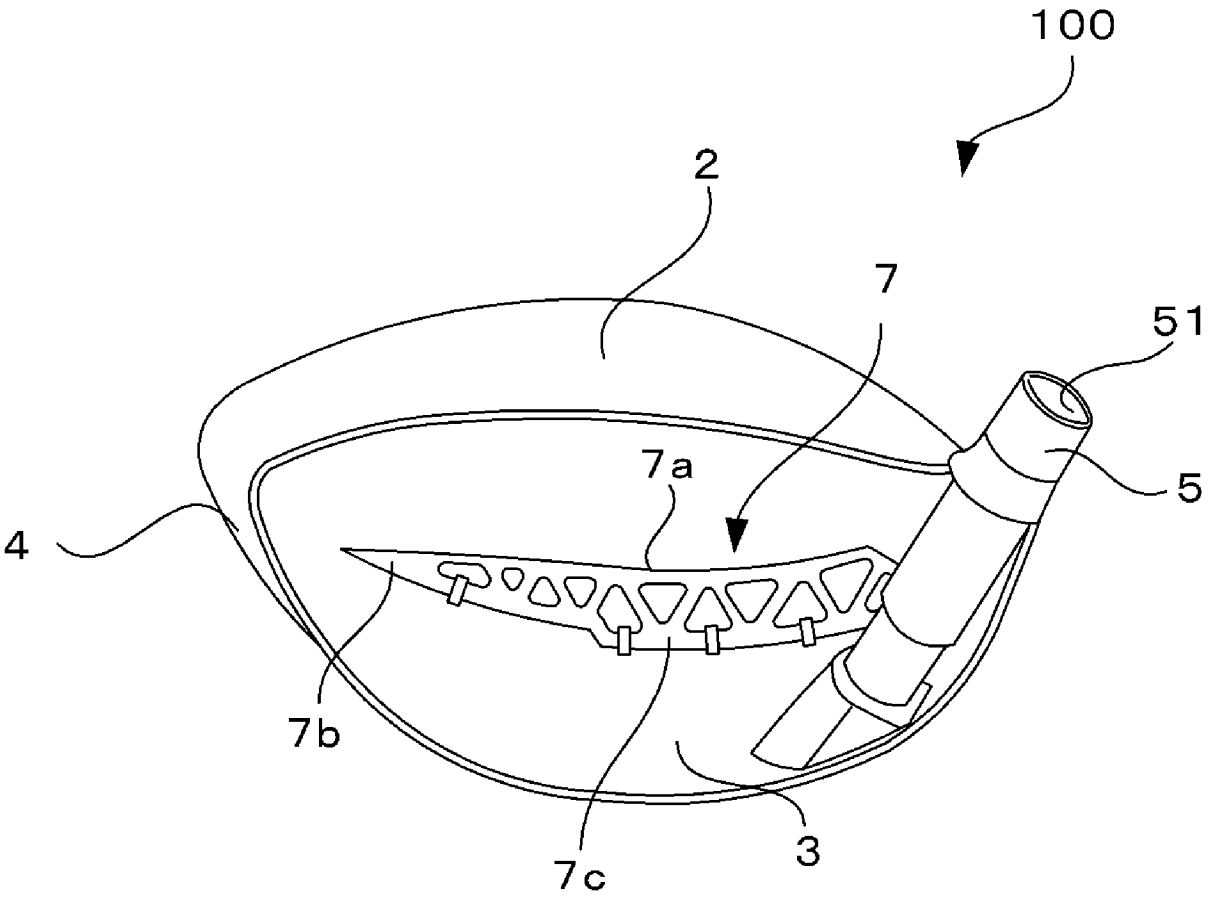
FIG. 4 is a diagram of the golf club head from which the face portion has been removed, viewed from on the front side.
Figure 5:
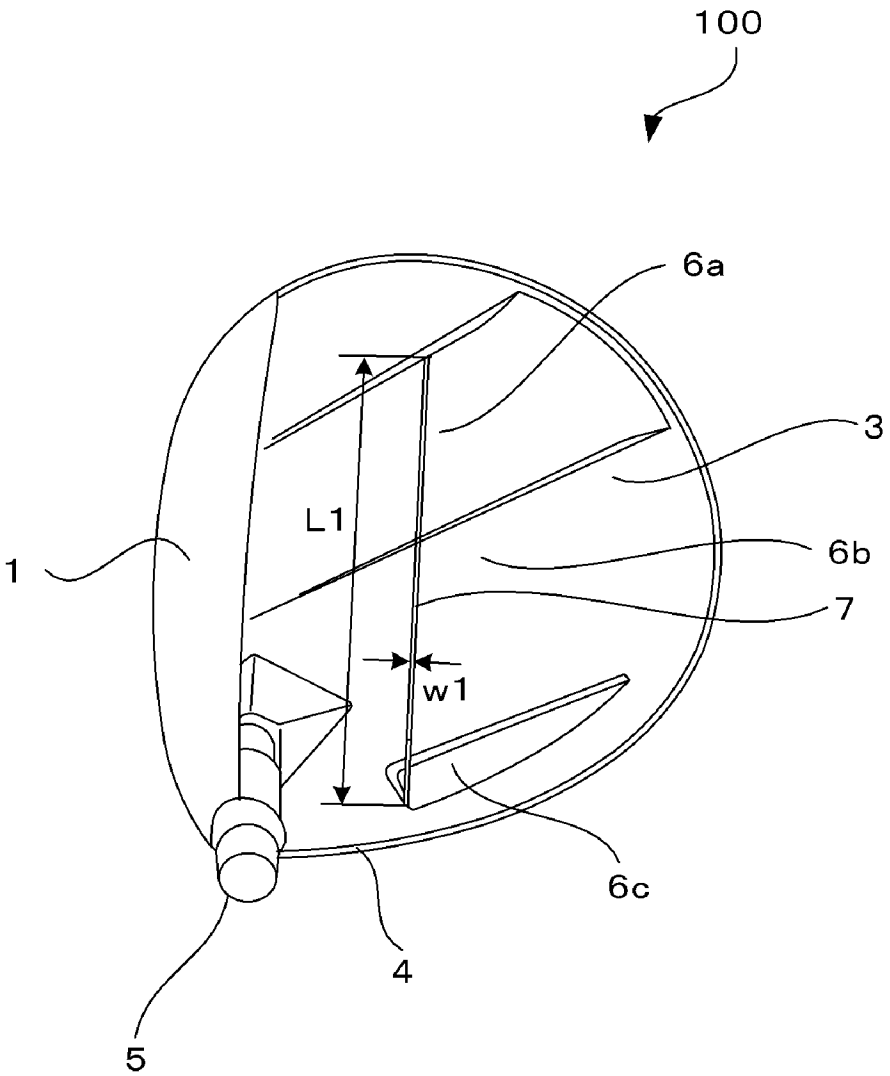
FIG. 5 is a plan view of the golf club head from which a crown portion has been removed.

FIG. 4 is a diagram of the head 100 from which the face portion 1 has been removed, seen from the front side, and FIG. 5 is a diagram of the head 100 from which the crown portion 2 has been removed, seen from above. FIGS. 4 and 5 show the internal space of the head body 6, and as shown in these figures, the rib 7 is formed on the inner surface of the sole portion 3. The rib 7 improves the rigidity of the head 100, plays the role of increasing the natural frequency of the head 100, and thus enables a high-pitch and pleasant sound to be obtained when a ball is hit. In order to increase the effect of improving rigidity, the rib 7 according to the present embodiment stands upright from the inner surface of the sole portion 3 so as to be approximately orthogonal to the inner surface, but a configuration is possible in which the rib 7 is formed so as to be inclined one way.

As shown in FIGS. 4 and 5, the rib 7 according to the present embodiment extends approximately parallel to the face portion 1. Accordingly, the rib 7 mainly suppresses flexing in the toe-heel direction and can increase the rigidity in the toe-heel direction. Also, the rib 7 according to the present embodiment is a thin plate-like member, and has an approximately uniform thickness w1 in the longitudinal direction thereof. The thickness w1 of the rib 7 can be appropriately set according to design conditions such as a rigidity value that is to be realized, the allowable weight of the rib 7 relative to the weight of the entire head 100, and the like, but a thickness w1 of 0.5 mm to 3.0 mm is preferable, and a thickness w1 of 0.7 mm to 2.0 mm is more preferable. In the case where the thickness w1 of the rib 7 is set low in such a manner, an increase in weight due to the rib 7 can be suppressed, and the rigidity of the head 100 can be efficiently improved. Also, a length L1 of the rib 7 in the longitudinal direction thereof can be appropriately set according to design conditions, but the length L1 can be 80 mm to 140 mm, and more preferably the length L1 can be 90 mm to 130 mm, for example. Also, the range of the values described above regarding the length L1 is particularly suited to the case where the volume of the head 100 is 400 $cm^3$ or more.

An upper end edge 7*a* of the rib 7 according to the present embodiment is approximately parallel to the outer edge of the part of the sole portion 3 on which the rib 7 stands upright, and is gently curved with an outward protruding shape. On the other hand, thick portions 6*a* and 6*c* that have been allocated free weight for purposes including realizing a designed position of the center of gravity of the head 100, and a thin portion 6*b* exist on the inner surface of the head body 6. For this reason, a height h1 of the rib 7 is approximately higher at the thin portion 6*b* and lower at the thick portions 6*a* and 6*c*, but the height h1 can be 3 mm to 10 mm at its highest, or more preferably the height h1 can be 4 mm to 8 mm, for example. Note that the height h1 of the rib 7 can be appropriately set according to the design conditions. Also, the shape of the rib 7 as well as the height h1 can change due to the curvature of the sole portion 3 as well as the thickness of the sole portion 3.

Figure 6:
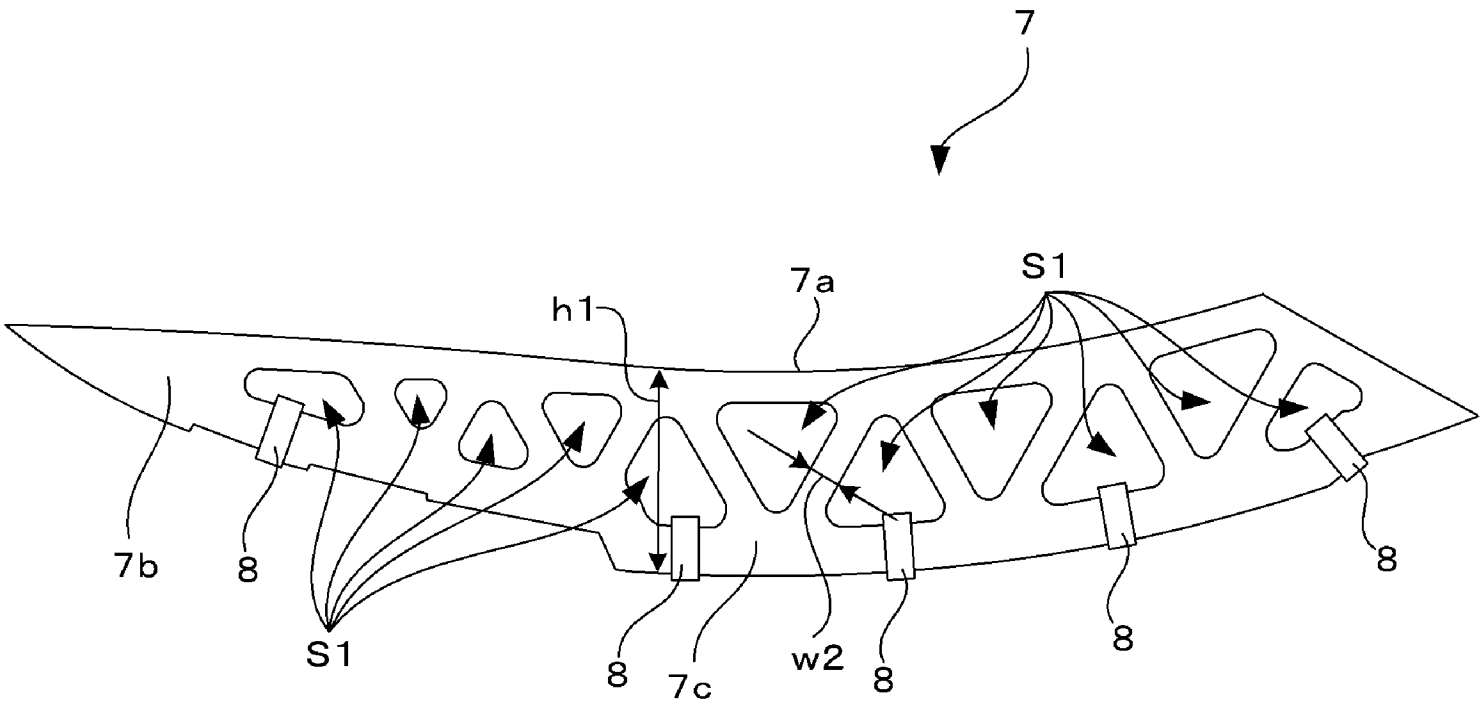
FIG. 6 is an enlarged view of a rib.

FIG. 6 is an enlarged view of the rib 7. As shown in FIG. 6, multiple holes (openings) S1 are formed in the side faces of the rib 7. As a result, a reduction in the weight of the head 100 can be achieved without reducing the effect of the rib 7 improving the rigidity. Note that the holes S1 are through holes.

While there may be exceptions for some of the holes S1 due to the shape of the rib 7, the holes S1 according to the present embodiment are mainly all triangular in shape. Note that the term triangular mentioned here is a concept that includes approximate triangles, and also includes shapes in which at least one corner or at least one side, or both are curved. In the present embodiment, the holes S1 are mainly all approximately equilateral triangles. Furthermore, the holes S1 are aligned in a region 7*c* excluding the end portion 7*b* on the toe side of the rib 7 such that the sides of two adjacent triangles are approximately parallel to each other. Specifically, the rib 7 according to the present embodiment has an approximately constant interval w2 between adjacent holes S1, and is formed of a truss structure such as that formed by connecting beams that have a width w2. As a result, a reduction in the weight of the head 100 can be effectively realized without hampering the strength of the rib 7 and thus the effect of the rib 7 improving the rigidity.

The width w2 of the beams can also be appropriately set according to the design conditions, but the width w2 can be 0.5 mm to 3.0 mm, and more preferably the width w2 can be 0.7 mm to 2.0 mm, for example. Note that the width w2 can differ depending on the place. In other words, the rib 7 can have a truss structure such as one formed by assembling beams of different widths w2. Also, the width w2 may change in the same beam and the outlines of the beam in the longitudinal direction does not need to be parallel. Also, the ratio of the volume occupied by the holes S1 in relation to the volume of the entire rib 7 can be appropriately set according to design conditions, but the ratio is 10% to 70%, or more preferably 20% to 50%, for example.

The rib 7 according to the present embodiment is made of a raw material different from that of the head body 6, or more specifically, an aluminum alloy or pure aluminum with a specific gravity of about 2.5 to 2.9. Accordingly, the rib 7 is constituted of a material with a specific gravity lighter than that of the head body 6. As a result, reducing the weight of the head 100 can be achieved without reducing the effect of the rib 7 improving the rigidity.

The rib 7 is fixed to the sole portion 3 in the manner described below. First, the rib 7, which is separate from the sole portion 3, is arranged at a predetermined position on the inner surface of the sole portion 3. In this state, a bead line 8 of a welding bead is formed such that it starts from the sole portion 3, passes through a hole S1 of the rib 7, and returns again to the sole portion 3 (see FIG. 7). On the sole portion 3, the bead line 8 extends so as to start from a base portion on one side face of the rib 7, rise up along the side face, pass through the hole S1 along a region that defines the lower end edges of the hole S1 in the rib 7, descend along the other side face of the rib 7, and reach the base portion of the rib 7 on the other side face. Accordingly, the bead line 8 takes on an upside down U shape. The filler material that forms the bead line is the same as that of the sole portion 3. Thus, the bead line 8 does not adhere to the rib 7 that is made of a different raw material, but the two end portions of the bead line 8 adhere to the sole portion 3. Accordingly, the bead line 8 is a supporting member that supports the rib 7 on the sole portion 3. Note that the term same raw material includes a raw material whose base is the same alloy, and for example, Ti-3Al-1Zr-1V-1Mo and Ti-6Al-4V can also be called the same raw material. From another perspective, same raw material means similar types of raw materials such as those that can be easily welded to each other. Also, the term different raw material refers to not being the same raw material.

Figure 7:
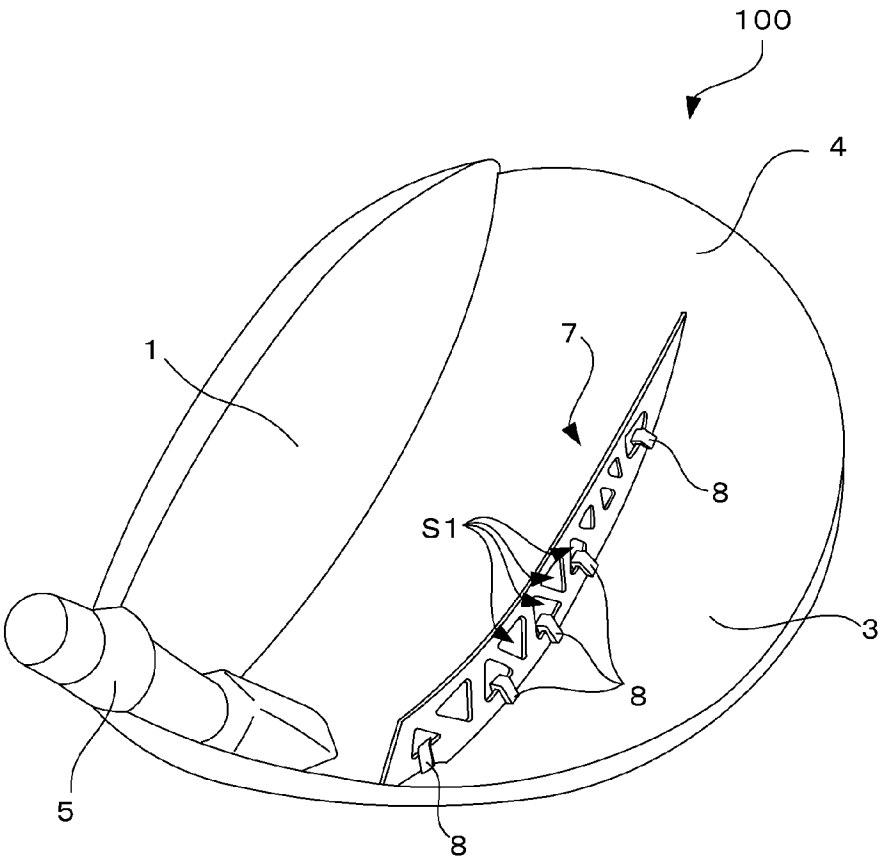
FIG. 7 is a view of the golf club head from which the crown portion has been removed, viewed from obliquely above.

In the present embodiment, as shown in FIG. 7, a plurality of bead lines 8 are formed passing through different holes S1. As a result, the rib 7 is supported at a plurality of places, and the position of the rib 7 on the sole portion 3 is stabilized.

Normally it is difficult to anchor members of different raw materials through welding. However, by using the fixing structure described above, the rib 7 made of a raw material different from that of the sole portion 3 can be fixed to the sole portion 3.

3. Modifications

An embodiment of the present invention has been described above, but the present invention is not limited to the above-described embodiment, and various modifications are possible as long as they do not depart from the gist of the present invention. For example, the following modifications are possible. Also, any combination of the features of the following modifications can be used as appropriate.

3-1

The shape of the holes S1 formed in the rib 7 is not limited to the above description, and can be circular, elliptical, or a polygon other than a triangle, such as a quadrangle, a pentagon, or the like, for example. Also, even in the case of a triangle, there is no limit to the triangle being an equilateral triangle, and may be formed to be any triangle. It should be noted that, from the perspective of aligning the triangular holes S1 so that the rib 7 forms a truss structure, it is preferable that the holes S1 are equilateral triangles, right angle triangles, isosceles triangles, or the like. In the case of quadrangles, it is preferable that the holes S1 are squares, rectangles, or parallelograms. In other words, regarding the shape of the holes S1, a shape that facilitates a dense arrangement of the holes S1 is preferable.

Note that, in the case where the holes S1 are formed so as to be polygons, the rigidity of the rib 7 relative to the weight of the rib 7 (hereinafter, specific rigidity) can be effectively improved. Also, in the case where a plurality of triangular holes S1 are formed and at least a part of the rib 7 has a truss structure, the specific rigidity of the rib 7 can be further efficiently improved.

In the case of the present modification as well, similarly to the above-described embodiment, the rib 7 and the head body 6 can be fixed to each other by the bead lines 8 that pass through the holes S1.

3-2

Figure 8:
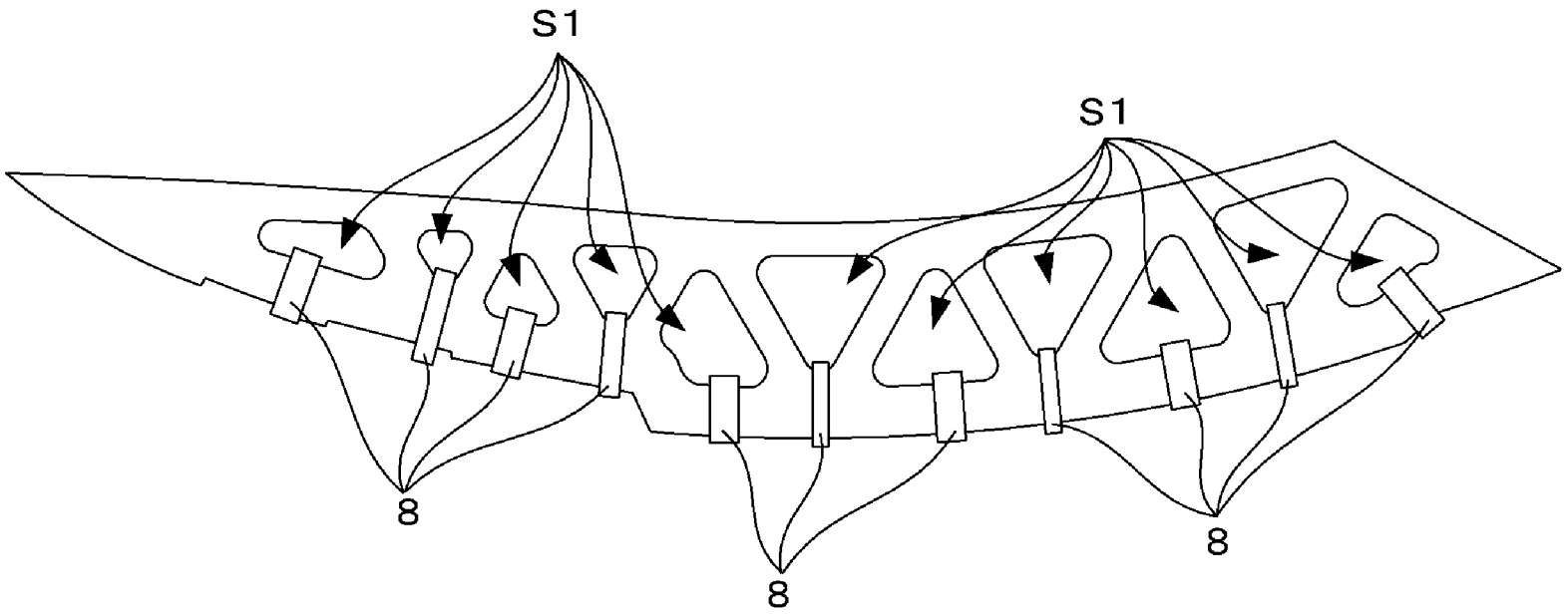
FIG. 8 is a diagram showing a rib according to a modification.

In the above-described embodiment, the bead lines 8 are only attached to some of the holes S1 that are aligned in the longitudinal direction of the rib 7. However, as shown in FIG. 8, the bead lines 8 can be attached to all of the holes S1, and in this case, the rib 7 can be more firmly fixed. However, in view of reducing weight, it is preferable to only attach bead lines 8 to some of the holes S1, provided that the rib 7 can be fixed. Note that in order to firmly fix the rib 7 with fewer bead lines 8, it is preferable that the bead lines 8 are attached at approximately equal intervals, as described in the previous embodiment.

3-3

Figure 9:
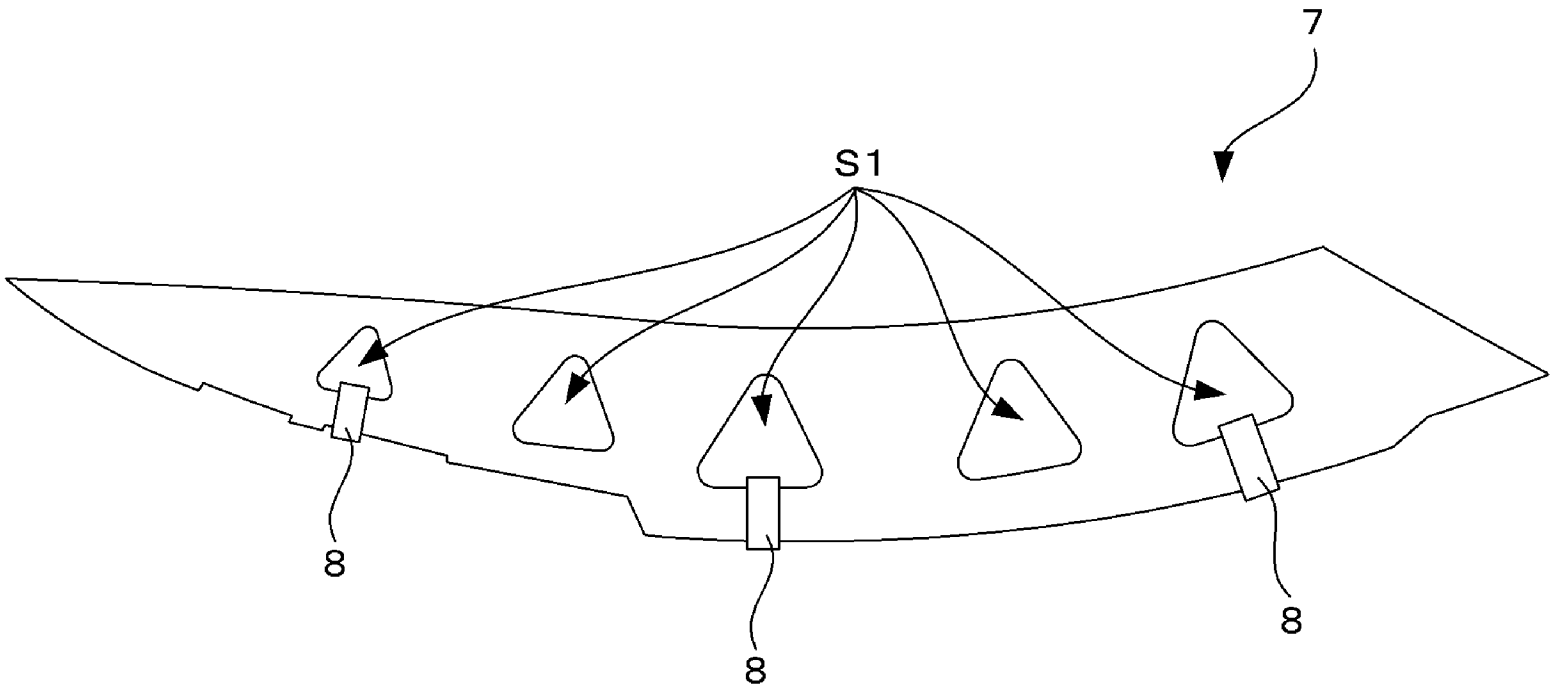
FIG. 9 is a diagram showing a rib according to another modification.

The number of holes S1 formed in the rib 7 may be one. Also, in the case where a plurality of holes S1 are formed in the rib 7, it is possible to not only combine holes S1 of the same shape, but also to combine holes S1 of different shapes. For example, holes S1 of different triangular shapes can be combined, and triangular holes S1 and quadrangular holes S1 can also be combined. Also, for example, as shown in FIG. 9, the holes S1 can be aligned such that the rib 7 does not have a truss structure. Note that in the case of this modification as well, similarly to the above-described embodiment, the rib 7 and the head body 6 can be fixed to each other by the bead lines 8 that pass through the holes S1.

3-4

A plurality of ribs 7 with the holes S1 formed therein can be formed on the inner surface of the head body 6. Also, a rib 7 with holes S1 formed therein can be combined with a rib without holes S1 formed therein. In the case of this modification as well, similarly to the above-described embodiment, the rib 7 and the head body 6 can be fixed to each other by the bead lines 8 that pass through the holes S1.

3-5

The position where the rib 7 is to be formed is not limited to the position described above. For example, the rib 7 may be formed on the inner surface of any of the crown portion 2, the side portion 4, and the face portion 1, and the rib 7 can be formed spanning the inner surface of a region including two or more portions selected from the portions 1, 2, 4, and the sole portion 3.

Also, the direction in which the rib 7 extends is not limited to the direction described above, and for example, the rib 7 can be formed so as to extend in the toe-heel direction, in the face-back direction, in the top-sole direction, or with an angle relative to these directions. Also, the rib 7 does not need to extend in a straight line along the longitudinal direction, and may be curved. Specifically, on the inner surface of the head body 6, the rib 7 can be formed in any manner at a location at which rigidity is to be improved, and along a direction in which rigidity is to be improved.

In the case of this modification as well, similarly to the above-described embodiment, the rib 7 and the head body 6 can be fixed to each other by the bead lines 8 that pass through the holes S1.

3-6

Figure 10:
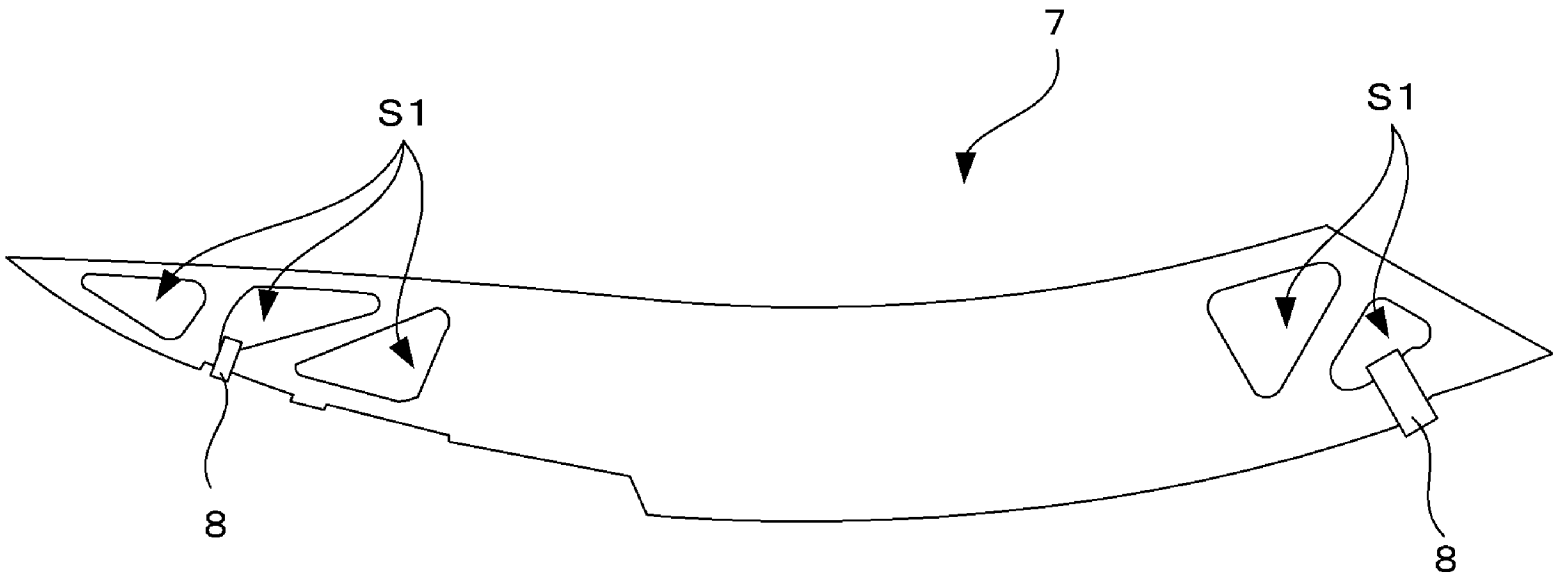
FIG. 10 is a diagram showing a rib according to yet another modification.

In the above-described embodiment, in the end portion 7*b* with a low height on the toe side of the rib 7, no hole S1 is formed due to difficulty in molding, but holes S1 can be formed over the entirety of the rib 7. Also, even in the case where the holes S1 are only formed in part of the rib 7, as shown in FIG. 10, the holes S1 can be formed in regions different from those of the rib 7 in the above-described embodiment, for example.

Usually, in the primary natural mode of vibration there are many cases in which the antinode of vibration is in the vicinity of the center of the sole face and the node of vibration is in the vicinity of the outer circumference of the sole face, and further improvement in rigidity by the rib 7 is required in the vicinity of the antinode of vibration. Accordingly, as shown in FIG. 10, a configuration can be employed in which no hole S1 is formed in the rib 7 in the vicinity of the antinode of vibration in the head body 6. Specifically, the effect of the rib 7 improving the rigidity would be slightly reduced in the periphery of the area where the holes S1 are formed in the rib 7. Accordingly, it can be said that it is preferable that the holes S1 are formed in the vicinity of the node of vibration, which is a region where a reduction in the effect of the rib 7 improving rigidity would not pose a problem relatively speaking. Naturally, the holes S1 may be formed at both the antinode and the node of vibration, but by concentrating the holes S1 in the vicinity of the node of vibration without forming the holes S1 in the vicinity of the antinode of vibration or only forming a few holes S1 near the antinode of vibration, the rigidity can be effectively maintained.

In the case of this modification as well, similarly to the above-described embodiment, the rib 7 and the head body 6 can be fixed to each other by the bead lines 8 that pass through the holes S1.

3-7

In the above-described embodiment, the rib 7 and the head body 6 are made of different raw material, but they may be made of the same raw material. Note that the head body 6 does not need to be made of entirely the same raw material, and it is possible to select different materials depending on the region. In this case, the rib 7 and the region where the rib 7 is formed on the head body 6 (first region) may be made of different raw materials, or may be made of the same raw material. In the case of this modification as well, similarly to the above-described embodiment, the rib 7 and the head body 6 can be fixed to each other by the bead lines 8 that pass through the holes S1.

WORKING EXAMPLES

A working example of the present invention will be described below. The present invention, however, is not limited to the following example.

The performance of a golf club head (working example) the same as that of the above-described embodiment was evaluated using simulations. The material and the weight of each region of the head body according to the present working example are as shown in Table 1.

Also, the same simulations were performed on a golf club head according to a comparative example. Note that the details of the golf club head according to the comparative example are as shown in Table 1. The configurations of the head bodies according to the comparative example and the working example were the same. Furthermore, the golf club ribs according to the comparative example and the working example were made of different materials, and the rib according to the comparative example had no holes and was formed integrally with the head body.

TABLE 1

| Part name | Material | ($g/cm^3$) | Comparative example Weight (g) | Working example Weight (g) |
|---|---|---|---|---|
| Sole portion and side portion | Ti-3Al-1Zr-1V-1Mo | 4.5 | 71.06 | 71.06 |
| Face portion | Ti-6Al-4V | 4.42 | 71.23 | 71.23 |
| Crown portion | Ti-3Al-1Zr-1V-1Mo | 4.5 | 31.06 | 31.06 |
| Hosel portion | Ti-3Al-2V | 4.48 | 17.31 | 17.31 |
| Rib (comparative example) | Ti-3Al-1Zr-1V-1Mo | 4.5 | 2.45 | — |
| Rib (working example) | A5052 | 2.68 | — | 1.46 |
| Filler material | Ti-3Al-1Zr-1V-1Mo | 4.5 | 0.15 | 0.57 |
| | | Total | 193.26 | 192.69 |

Table 2 shows the results of evaluating the following evaluation items: the height of the sweet spot; the distance from the face center to the sweet spot in the horizontal direction (SS-X); the distance from the face center to the sweet spot in the vertical direction (SS-Y); the distance to the center of gravity; the depth of the center of gravity; the left-right moment of inertia; and the up-down moment of inertia.

TABLE 2

| | | | Comparative example | Working example |
|---|---|---|---|---|
| Sweet spot position | Height | (mm) | 33.98 | 33.99 |
| | SS-X | (mm) | −0.86 | −0.85 |
| | SS-Y | (mm) | 3.08 | 3.10 |
| Distance to center of gravity | | (mm) | 40.59 | 40.57 |
| Depth of center of gravity | | (mm) | 37.65 | 37.60 |
| Moment of inertia | Left-right | ($g/cm^2$) | 4309 | 4301 |
| | Up-down | ($g/cm^2$) | 2640 | 2638 |

According to Table 1, in the working example, the weight of the filler material is increased due to the formed welding beads, compared to the comparative example, but the weight of the rib was reduced by about 1.0 g, and therefore the overall weight was reduced by 0.57 g. On the other hand, according to Table 2, the performance of the golf club head was largely unchanged. Accordingly, it was confirmed that by using a fixing structure that employs welding beads passing through holes in the rib, the weight of the golf club head could be reduced while ensuring the required performance demanded of the golf club head.

REFERENCE SIGNS LIST

1 Face portion
2 Crown portion
3 Sole portion
4 Side portion
6 Head body
7 Rib
7*b* Toe side end portion
7*c* Region excluding toe side end portion
100 Golf club head
S1 Opening

The invention claimed is:

1. A golf club head comprising:

a head body that has a hollow structure and includes a first region;

a rib that stands upright from an inner surface of the first region; and a welding bead that fixes the first region and the rib to each other, wherein an opening is formed in side faces of the rib, and the welding bead extends from a first position on the inner surface of the first region, passes through the opening, and reaches a second position on the inner surface of the first region.

2. The golf club head according to claim 1, wherein the rib is made of a raw material that is different from that of the first region.

3. The golf club head according to claim 2, wherein the rib is made of a material that has a lower specific gravity than that of the first region.

4. The golf club head according to claim 3, wherein the opening includes a plurality of holes.

5. The golf club head according to claim 4, wherein the welding bead includes a plurality of bead lines that pass through different holes.

6. The golf club head according to claim 3, wherein the first region is a sole portion.

7. The golf club head according to claim 2, wherein the opening includes a plurality of holes.

8. The golf club head according to claim 7, wherein the welding bead includes a plurality of bead lines that pass through different holes.

9. The golf club head according to claim 2, wherein the first region is a sole portion.

10. The golf club head according to claim 2, wherein the opening includes at least one non-circular shaped hole.

11. The golf club head according to claim 1, wherein the opening includes a plurality of holes.

12. The golf club head according to claim 11, wherein the welding bead includes a plurality of bead lines that pass through different holes.

13. The golf club head according to claim 12, wherein the plurality of holes are each a triangle and are aligned such that the rib at least partially forms a truss structure.

14. The golf club head according to claim 12, wherein the first region is a sole portion.

15. The golf club head according to claim 11, wherein the plurality of holes are each a triangle and are aligned such that the rib at least partially forms a truss structure.

16. The golf club head according to claim 15, wherein the first region is a sole portion.

17. The golf club head according to claim 11, wherein the first region is a sole portion.

18. The golf club head according to claim 1, wherein the first region is a sole portion.

19. The golf club head according to claim 1, wherein the opening includes at least one non-circular shaped hole.

* * * * *